United States Patent [19]

Mustoe et al.

[11] 4,142,471

[45] Mar. 6, 1979

[54] PALLET HAVING REINFORCED GYPSUM STRUCTURAL MEMBERS

[75] Inventors: Robert M. Mustoe, Winnetka; Fred H. Zajonc, Palatine, both of Ill.

[73] Assignee: United States Gypsum Company, Chicago, Ill.

[21] Appl. No.: 731,157

[22] Filed: Oct. 12, 1976

Related U.S. Application Data

[62] Division of Ser. No. 430,352, Jan. 2, 1974, abandoned.

[51] Int. Cl.[2] ..... B65D 19/00

[52] U.S. Cl. ..... 108/57.1; 108/51.1

[58] Field of Search ..... 108/57.1, 51.3, 51.1; 206/386, 595, 596, 597, 598, 599, 600, 322

[56] References Cited

U.S. PATENT DOCUMENTS

| | | | |
|---|---|---|---|
| 1,724,740 | 8/1929 | Utzman | 206/322 |
| 2,388,730 | 11/1945 | Fallert | 108/57.1 |
| 2,444,183 | 6/1948 | Cahners | 108/51.3 |
| 2,501,506 | 3/1950 | George | 108/57.1 |
| 2,503,240 | 4/1950 | Cahners | 108/51.3 |
| 2,535,422 | 12/1950 | Jones | 206/321 X |
| 2,544,743 | 3/1951 | Vrabcak | 108/51.3 |
| 3,488,904 | 1/1970 | Schneller et al. | 52/241 |
| 3,522,688 | 8/1970 | Kaliwoda et al. | 206/597 |
| 3,788,462 | 1/1974 | Meincer | 206/497 |
| 3,809,223 | 5/1974 | Kendall | 206/321 |
| 3,835,986 | 9/1974 | Le Beau | 206/497 |
| 3,858,526 | 1/1975 | Lombard | 108/55.1 X |

FOREIGN PATENT DOCUMENTS

| | | | |
|---|---|---|---|
| 541733 | 12/1941 | United Kingdom | 52/241 |

*Primary Examiner*—James T. McCall

*Attorney, Agent, or Firm*—Samuel Kurlandsky; Robert H. Robinson; Glenn W. Olson

[57] ABSTRACT

A pallet comprising a generally flat top sheet and a generally flat bottom sheet spaced from the top sheet. A plurality of sills constructed from elongate generally flat rehydrated gypsum strips are sandwiched between the top and bottom sheets. A water-impervious cover is closely positioned over the sheets and over the edges of the sills.

1 Claim, 7 Drawing Figures

PALLET HAVING REINFORCED GYPSUM STRUCTURAL MEMBERS

This is a divisional of application Ser. No. 430,352, filed Jan. 2, 1974, now abandoned.

The rising cost of virgin timber is rapidly pricing structural members made therefrom out of the market. Wooden structural members such as beams have been used not only in the construction of buildings, but also in the storage and shipment of hard goods such as steel sheets, lath, coils, and the like. When used in this fashion, the beams are called "dividers" or "supports". Generally, such supports are bundled along with the goods as top and bottom supports, and even in some cases as side members, tie wires being wrapped around the goods and the supports as an entire package. An example is shown in U.S. Pat. No. 2,677,323. Typically, the dividers or supports, and the goods shipped therewith, are handled by unskilled labor, with an emphasis placed on rapid handling. For this reason, the dividers or supports have been treated as disposable dunnage, and no concerted attempts have been made to reuse the members.

The increased cost of raw lumber has made it necessary to manufacture such supports from alternate materials. Steel and other metallic members have been tried, but the expense of such materials has also been great, rendering it necessary that the beams be returned for reuse. Such reuse requires too much accountability to make metal a suitable alternative.

Still other materials have been attempted. U.S. Pat. No. 2,833,403 is representative of the use of paperboard or collar strips. Beams in general have been constructed from capped laminates, such as is shown in U.S. Pat. No. 3,251,162. However, the strips forming the laminate in such cases are wood or plywood, so that the high cost of lumber has not been completely avoided.

A "raw" material which has a much lower cost than wood is gypsum panels or wallboard. Such panels can be ordinary, "no. 1" board, or they may be damaged or obsolete panels. Such damage can occur during any part of the processing of the panels. Thus, it may occur as blistering, peeling, and burning of the panels in the board or kiln line, or as damage during storage, transit or on site installation. Although such damage prevents the panel from being used as such, typically only a portion of the entire panel is damaged, leaving the remainder as a salvageable waste.

Strips have been cut from gypsum panels to create structural members such as studs, or even as supports or dividers. Typically, such strips have been laminated together by a suitable adhesive. An example of such a construction is shown in U.S. Pat. No. 3,488,904, wherein a metallic sheet has been sandwiched between strips as a reinforcement. The difficulty with such a construction has been that the gypsum strips are not water resistant. Water is a known erodent of rehydrated gypsum panels, as it weakens it, due to the slight solubility of gypsum. Furthermore, the ends of each strip have been left unprotected, and the gypsum core at the opposite side edges usually have been left exposed. Such unprotected ends are subject to crushing under load, particularly when metal straps or tie wires are wrapped around the bundled goods supported by the member. Such exposed side edges are subject to dusting, a crumbling effect of the gypsum crystals left exposed when the strips are formed by cutting the originally paper-covered panel. Dusting weakens the edges of the strips, causes rusting of the metal loads carried by the supports, contributes to cleanliness problems, and is esthetically unacceptable.

Thus, prior attempts to use such laminated gypsum strips made from paper-covered panels, as supports or dividers, have failed.

SUMMARY OF THE INVENTION

This invention relates to a structural member, and a method of making it, which member is particularly suited for compressive side loading, as when used in pallets or as supports for the shipment of goods, because it overcomes the aforedescribed problems. That is, a disposable structural member has been developed from inexpensive rehydrated gypsum strips, protected from end crushing and edge dusting. More specifically, there is provided an elongate structural member comprising a plurality of elongate, generally flat rehydrated gypsum strips assembled together face to face with a face of the outermost strips being exposed, each of said strips being of approximate equal length, having two opposite ends, means for attaching each of said strips to the next adjacent strip with the strip ends aligned, and a water-impervious cover enclosing said strips, whereby said member is capable of withstanding compressive forces of at least about 500 pounds per square inch, delivered transversely to the longitudinal axis of the member.

Accordingly, it is an object of the invention to provide a disposable structural member capable of transverse compressive loading and which is particularly suited for use as a support or divider for the shipment of goods.

It is a related object of the invention to form such a member from inexpensive materials, thus minimizing the loss created by the one-time usage of the members as supports or dividers.

Yet another object of the invention is to form such members from gypsum panels, and to protect the ends and edges of such members from damage.

Still another object of the invention is to construct such a member so that it is suited for use in a pallet.

A further object of the invention is to provide an inexpensive method of making such a member.

Another object of the invention is to render such a member impervious to water.

Other objects and advantages will become apparent upon reference to the following brief description of the drawings and detailed discussion of the embodiments of the invention.

DESCRIPTION OF THE PREFERRED EMBODIMENTS

By means of the invention, an elongate disposable structural member is provided which has significant compressive strength delivered transversely to the longitudinal axis of the member. Although that member is hereinafter disclosed in connection with certain preferred uses, such as a divider, support, or pallet sill, it must be noted that it can be used in other environments where the only significant load, if any, is a compressive force delivered transversely to the longitudinal axis. Thus, the member may be used in static environments as a beam.

Figure 1:
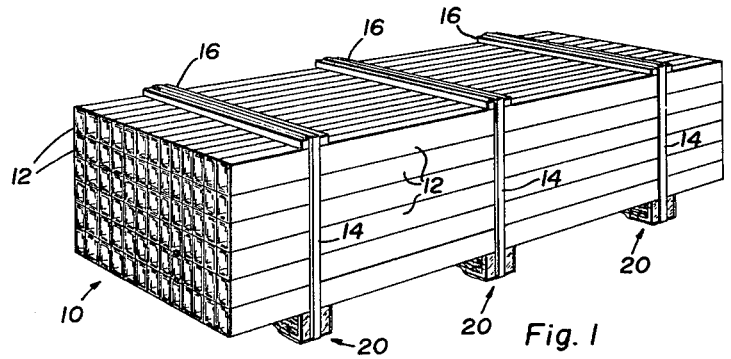
FIG. 1 is a perspective view of the structural member prepared in accordance with the invention, used as a divider or support in the storage and shipment of metal goods.

Turning now to FIG. 1, there is illustrated one such use of the structural member, wherein a stack 10 of metal studs 12 are bundled together by means of wire straps 14 and supports 16 and 20. The supports 16 preferably are conventional wooden beams, due to the forces in tension against which the structural member of the invention is not designed to operate.

Figure 2:
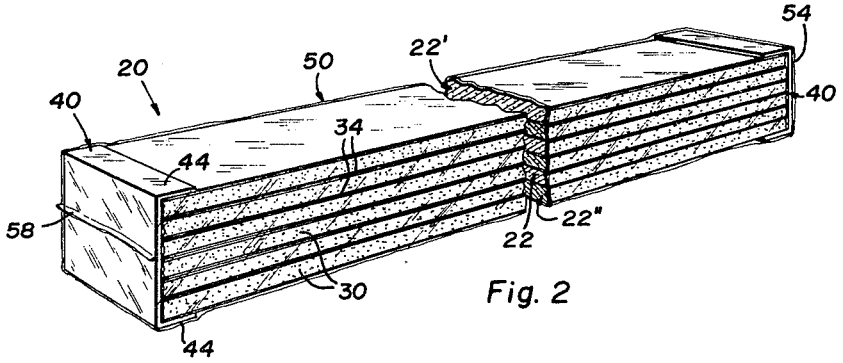
FIG. 2 is a detailed perspective view of the support shown in FIG. 1.
Figures 3, 5, 6:
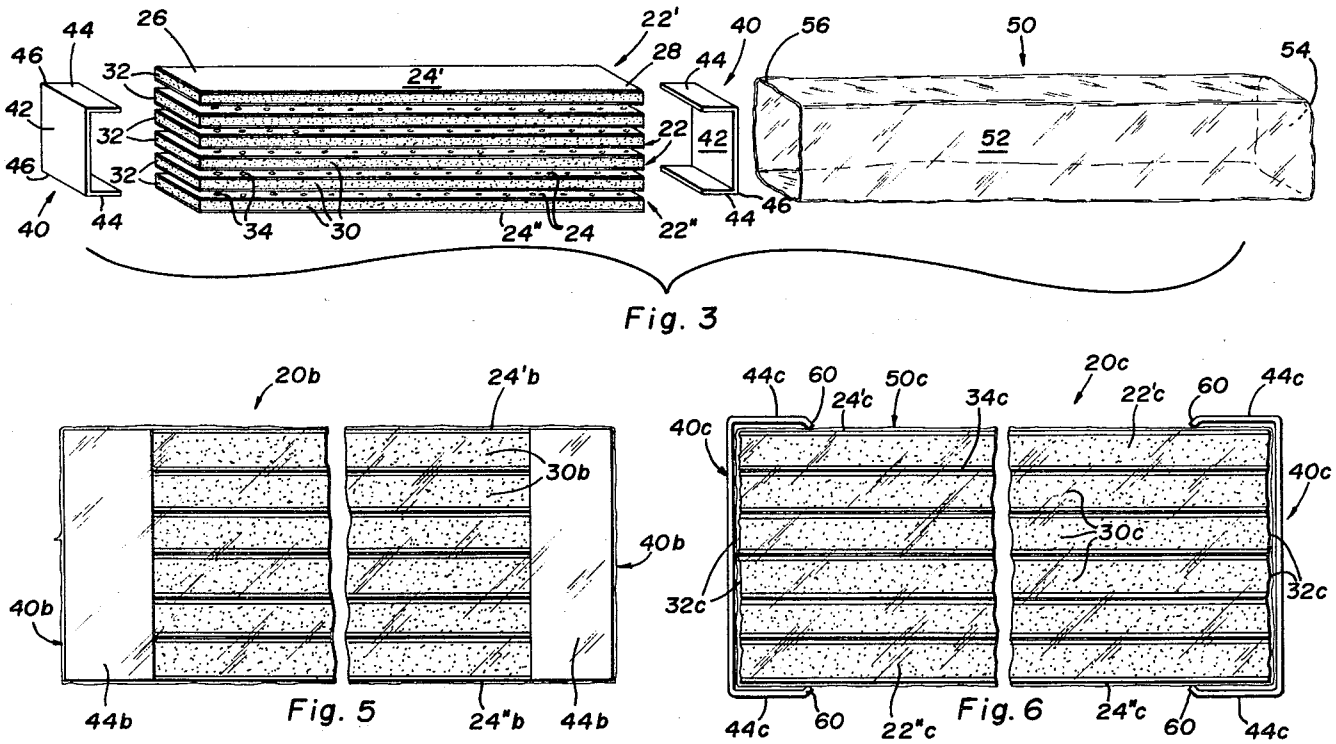
FIG. 3 is an exploded perspective view illustrating the preferred method of manufacturing the member of the invention.

In accordance with one aspect of the invention, as best seen in FIGS. 2 and 3, the supports 20 feature a plurality of rehydrated gypsum strips 22 held together by adhesive 34, and end caps 40 and a plastic envelope 50. The strips 22 and the adhesive provide the bulk of the structural member and the necessary compressive strength. The end caps 40 give toughness to the ends of the member. The envelope 50 is a barrier to water and prevents portions of the strips, including gypsum dust, from breaking away.

Considering first the details of the rehydrated gypsum strips 22, these strips are approximately of equal length, have opposite front and back faces 24, opposite ends 26 and 28 and circumferential edges including opposite side edges 30. By "rehydrated gypsum", it is meant calcium sulfate dihydrate crystals formed by calcining the dihydrate form of gypsum into the hemihydrate form, known as stucco, and thereafter recrystallizing the stucco by adding water under carefully controlled conditions, such as is done conventionally in making gypsum panels or wallboard. Indeed, the preferred starting material for strips 22 is such gypsum panels. To lower the cost, the panels may be those which are unsuited for more conventional uses because of damage or other factors. Alternatively, ordinary gypsum panels can be used. The damaged portions, if any, are removed by trimming the panel into usable strips. Since conventional panels have a paper cover sheet adhered to the rehydrated gypsum core, the faces 24 of the strips will also comprise the paper cover sheets, leaving however the gypsum crystals of the core exposed along edges 30 due to the cutting operation. The paper cover sheets need not be used, however, as will be apparent from the description below. Gypsum panels prepared without them are suitable substitute raw material.

If ordinary undamaged gypsum board is used, the paper cover sheet can be modified to be of lower grade or quality than would otherwise be the case.

In the assembly of the strips 22, the strips are stacked or assembled with faces 24 adjacent to the face of the next adjacent strip. The outermost strips 22' and 22'' will, of course, have an exposed face 24' and 24''. The ends 26 and 28 of each strip 22 are aligned, respectively, with the ends 26 and 28 of the next adjacent strips (FIG. 2), such that the edges 32 of the strip ends 26 and 28 form a generally flat end surface of the composite member defined by the stack of strips. That flat end surface is preferably perpendicular to exposed faces 24' and 24''.

Means must be provided to hold the strips in such a stacked configuration. Any adhesive 34 is suitable, provided the dry bond it creates between the strips 22 exceeds in strength the strength of the paper plies of the cover sheets of the strips, where paper is used, or the shear strength of the rehydrated gypsum, if no paper cover sheets are used. Suitable representatives will be apparent from permanent water-based or organic solvent-based solutions and emulsions, as well as from solid adhesive forms, including those having a thermosetting resin base, a thermoplastic resin base, and a natural rubber base. One example of such an adhesive is "USG Mobile Homes Adhesive", a polyvinyl acetate homopolymer base adhesive made by the United States Gypsum Company. Whatever the adhesive, it may be applied at discrete, spaced apart locations, as shown, or as a coat over the entire face 24 of each strip. Alternatively, staples or nails may be used.

To protect the ends 26 and 28, and the edges 32, from end crushing such as could be caused by wire straps 14, an end cap 40 is positioned over the ends 26 and 28, and edges 32. As shown in FIGS. 2 and 3, the cap may be a segment of a C-channel, with a generally flat web portion or sheet 42 and generally flat sheets or side flanges 44 extending at an angle from web portion 42, approximately parallel to each other. The web portion 42 thus covers and adjoins all the edges 32, while flanges 44 cover a portion of the exposed faces 24' and 24''. The web portion and flanges are integrally joined together at corners 46 which are preferably positioned over the intersection of edges 32 with one of the exposed faces 24' and 24''. The caps may be friction fit over the strips, or adhered by means of the adhesive used to attach the strips together.

It will be appreciated that the end caps may be selected from a variety of materials, including metal, plastics, and even wood, due to their small size.

In accordance with another aspect of the invention, an envelope or cover 50 is wrapped around the assembled strips 22 and end caps 40 to keep water from wicking or otherwise being absorbed into the strips, and to prevent dusting. That is, as noted in the "Background" above, unprotected gypsum strips are subject to water damage, and exposed gypsum crystals such as at edges 30 are subject to dusting. Therefore, the cover is water-impervious, and preferably completely encases the strips and end caps, thereby holding within the member dust and other portions which might break off. Preferably, the cover is either a tubular sheet or bag 52 having a closed end 54 and an open end 56, made from any of the heat-shrinkable, film-forming plastics, such as polyethylene and polyvinyl chloride. Or a continuous roll of film may be wrapped and sealed at all open edges. Such heat-sealable material permits easy assembly by slipping the assembled strips and caps into the open end 56, and thereafter heat-shrinking the bag and sealing end 56 at 58. This step conforms and adjoins the bag to the exterior surfaces of the caps 40, surfaces 24' and 24'' of the outermost strips and strip edges 30.

The method of assembly will be apparent from the preceding description. Briefly, it comprises the selection or manufacture of the rehydrated gypsum strips 22, followed by the steps of attaching the strips face-to-face with their ends 26 and 28 generally aligned, covering the strip ends with a cap, and covering or enclosing the strips and caps with a protective water-impervious sheet. Preferably, the strips 22 are obtained by treating damaged gypsum panels so as to cut off the damaged portions and so as to cut the undamaged portions into elongate strips. If the panels are originally paper-covered, then only the edges 30 expose the gypsum crystals of the core.

Such a member 20 has been found to provide considerable compressive strength measured transversely to the longitudinal axis of the member. Specifically, for loads delivered perpendicular to faces 24 of the strips 22, the member 20 will sustain a compressive load of 675 psi when assembled from six bone dry strips 22 each having a density of 43 lbs. per cubic foot and a thickness of ½ inch. In actual use, the strips will have a slight amount of moisture, probably on the order of 0.5%, and the compressive load strength will be about 500 psi in such a case. This compares favorably with a similar compressive loading capability of 800 psi of a green hardwood beam of similar dimensions, measured perpendicularly to the grain.

Thus, the structural member of the invention has sufficient compressive strength, without sacrificing its disposability. The inexpensiveness of the member arises from the use of rehydrated strips such as can be culled from damaged, otherwise unusable panels, the weaknesses of the strips being overcome by the use of caps 40 and the protective envelope 50.

Figure 4:
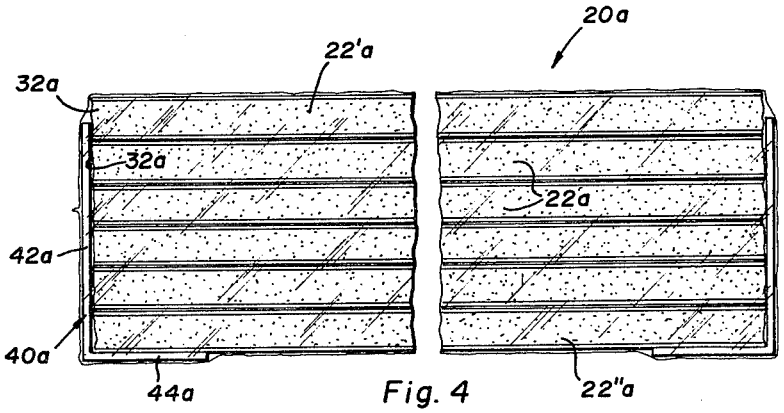
FIGS. 4–6 are fragmentary side elevational views illustrating alternate embodiments of the invention.

FIGS. 4 through 6 illustrate alternate embodiments wherein the end cap 40 has been modified in one way or another. Parts similar to those previously described bear the same reference numeral, to which the suffixes "a", "b", and "c", respectively, have been added.

Thus, the member **20*a* illustrated in FIG. 4 is identical in all respects to the previous embodiment, except that cap 40*a* comprises only sheet 42*a* and one sheet or side flange 44*a*, the sheet 42*a* not necessarily covering all of the edges 32*a* of the strips 22*a*. Such a member 20*a* is particularly suited for use as a divider or support wherein strip 22'*a* will be in contact with the load and only 22''*a* will be adjacent, during use, to the wire straps used to bundle the supports to the load. In such a use, there is no danger that the wire strap will end crush strip 22'*a***.

FIG. 5 illustrates another alternate embodiment identical to that shown in FIGS. 2 and 3, except that the cap **40*b* of member 20*b* has been rotated 90°. The side flanges 44*b* thus cover a portion of the strip edges 30*b*, and not the faces 24'*b* or 24''*b***. This construction is particularly useful in the formation of a pallet, as described below.

FIG. 6 depicts yet another alternative embodiment wherein the construction of member **20*c* is identical to that shown in FIGS. 2 and 3, except that the end caps 40*c* have been moved so as to fit exterior to and over the protective cover 50*c*. Attachment of the caps can be accomplished by the use of adhesive 34*c*, or by staking or impaling the ends 60 of side flanges 44*c* so as to penetrate into the strips 22'*c* and 22''*c*. It will be appreciated that, in this case, the bag or cover 50*c*, when formed from heat-shrinkable plastic, will conform to the surfaces 24'*c* and 24''*c*, side edges 30*c*, and end edges 32*c***, of the strips.

Figure 7:
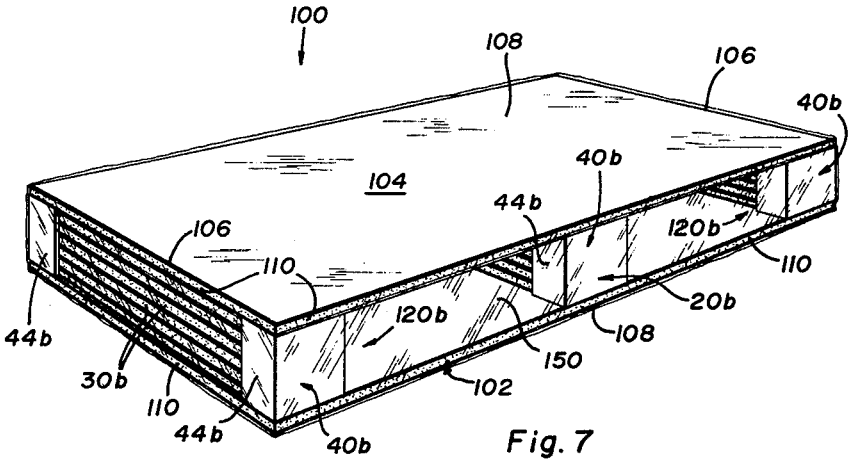
FIG. 7 is a perspective view of a pallet prepared in accordance with the invention.

Other uses are possible for the member 20 described above. FIG. 7 illustrates one such use, particularly of the embodiment shown in FIG. 5. Thus, a pallet 100 comprises a bottom sheet 102, a top sheet 104 superimposed with respect to the bottom sheet, and a plurality of the members **20*b* and 120*b*** sandwiched between the sheets, spacing them apart. In this construction, the members are known as sills, the spacing between the sills being necessary for fork-lift engagement with the pallet.

In pallet construction, the outside sills, identified by the numeral **120*b*, are positioned adjacent to the short outside edges 106 of the sheets 102 and 104, with the sills 20*b* being spaced away from those edges. Sills 120*b* are identical to sills 20*b* described above, except for their position in the pallet. As the edges 106 are conventionally parallel, all the sills are preferably mutually parallel. The position of end caps 40*b* of sills 20*b* is particularly useful in the construction of the pallet, to insure uniform flatness on the end bottom surfaces 24'*b* and 24''*b*** of the sill.

As shown in FIG. 7, the sheets 102 and 104 are preferably gypsum panels having exposed faces 108 and circumferential edges 110. They may, however, be conventional materials, such as plywood or rough cut lumber strips.

To protect the entire pallet, sheets and sills, a water-impervious cover 150 preferably extends over the sheet faces 108 and edges 110 as well as over the exposed side edges 30 of the sills **120*b*. The cover 150 is preferably the same material as envelope 50*b*. For this reason, the plastic sheet or envelope 50*b* can be omitted from the sills per se. It will be readily appreciated that the cover 150 may completely envelope the pallet, as shown, or it may be confined just to the exposed faces 108, edges 110, and exposed side edges 30*b* of sills 120*b*. In the enveloping construction, shown in FIG. 7**, the fork-lift readily penetrates through the envelope, without tearing the cover off the surfaces requiring protection.

A further modification which is possible in the pallet 100 is the elimination of the end caps **40*b*** from the sills.

Thus the invention provides a structural member particularly useful as a divider, support, or pallet sill. It provides a structural member which is disposable after a single use because it is inexpensive. Yet it provides a structural member having adequate compressive strength and resistance to end-loading, edge crumbling, and water absorption. Furthermore, it is particularly suited for use with salvageable portions of gypsum panels otherwise considered of waste value only.

Although the invention has been described in connection with certain preferred embodiments, it is not limited thereto. For example, each strip of rehydrated gypsum can be provided with its own end cap for each end thereof. Or the water-impervious sheet 50 can be attached to and cover only the exposed side edges 30 of the strips, and only that portion of faces 24' and 24'' as is necessary to affix the sheet 50. Therefore, it is intended that the invention cover all alternative arrangements, embodiments, and equivalents as may be included within the scope of the following claims.

What is claimed is:

1. A pallet comprising a generally flat bottom sheet and a generally flat top sheet superimposed with respect to the bottom sheet, a plurality of sills sandwiched between and spacing apart said sheets, a sill being positioned adjacent to each of two opposite edges of the sheets, each of said sills further comprising a plurality of elongate, generally flat rehydrated gypsum strips having opposite faces terminating in circumferential edges, said strips being assembled together face to face, each of said strips being of approximate equal length, having two opposite ends, means for attaching each of said strips to the next adjacent strip with the strip ends aligned, and a water-impervious cover closely positioned over said sheets and over at least some of the circumferential edges of said edge-adjacent sills arranged to be interposed between said pallet and a load placed thereon.

* * * * *